US011435108B2

(12) United States Patent
Stewart

(10) Patent No.: US 11,435,108 B2
(45) Date of Patent: Sep. 6, 2022

(54) APPARATUS FOR NON-CONDUCTIVE REFRIGERANT LINE BREAK

(71) Applicant: E. K. Fox & Associates, Ltd., Chantilly, VA (US)

(72) Inventor: Raleigh D. Stewart, Chantilly, VA (US)

( * ) Notice: Subject to any disclaimer, the term of this patent is extended or adjusted under 35 U.S.C. 154(b) by 140 days.

(21) Appl. No.: 16/848,636

(22) Filed: Apr. 14, 2020

(65) Prior Publication Data

US 2021/0318020 A1 Oct. 14, 2021

(51) Int. Cl.
*F24F 11/88* (2018.01)
*F24F 11/89* (2018.01)

(52) U.S. Cl.
CPC ..... *F24F 11/88* (2018.01); *F24F 11/89* (2018.01)

(58) Field of Classification Search
CPC ..... F24F 11/88; F24F 11/89
See application file for complete search history.

(56) References Cited

U.S. PATENT DOCUMENTS 4,895,203 A * 1/1990 McLaren ..... F28D 7/024 165/156
7,142,425 B2 * 11/2006 Tomioka ..... G06F 1/203 361/699
7,428,151 B2 * 9/2008 Sonnabend ..... G06F 1/20 361/698
7,614,247 B2 * 11/2009 Nicolai ..... H05K 7/20772 165/80.4
8,436,246 B1 * 5/2013 Scofield ..... H05K 7/20272 174/137 R
2004/0070942 A1 * 4/2004 Tomioka ..... G06F 1/203 361/700

* cited by examiner

*Primary Examiner* — Nelson J Nieves
(74) *Attorney, Agent, or Firm* — John L. Sotomayor

(57) ABSTRACT

The present invention is a device for providing a non-conductive refrigerant line break that provides an electrical discontinuity in a high-pressure metallic refrigerant line. The present invention could be used for the installation of HVAC units in which metallic refrigerant lines would necessarily penetrate a security partition or security wall. In an embodiment, a conductive line run external to a secure facility would be broken by a non-conductive line approximately contemporaneously with the conductive line's wall penetration or entirely within an internal cavity. The non-conductive line would run a distance determined by a consulting engineer to provide sufficient security given the application. The non-conductive line would then be attached to a conductive line within the secure facility. The present invention utilizes a non-threaded fitting extension to increase surface area for epoxy bonding.

10 Claims, 2 Drawing Sheets

APPARATUS FOR NON-CONDUCTIVE REFRIGERANT LINE BREAK

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

Metal utility lines that serve to connect disparate Heating, Ventilation, and Air Conditioning (HVAC) units typically penetrate the partitions and walls that define discrete habitation or storage areas. Just as such lines may carry fluids, gases, or solids within the lines' hollow centers, the metallic outer portions of such lines may carry electrical charge past and through any penetrated partition or wall. Electrical continuity is an inherent feature of a metallic line absent any non-conductive break. Historically, non-conductive line breaks have been successfully installed on no or low-pressure systems, such as those including chilled water lines.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
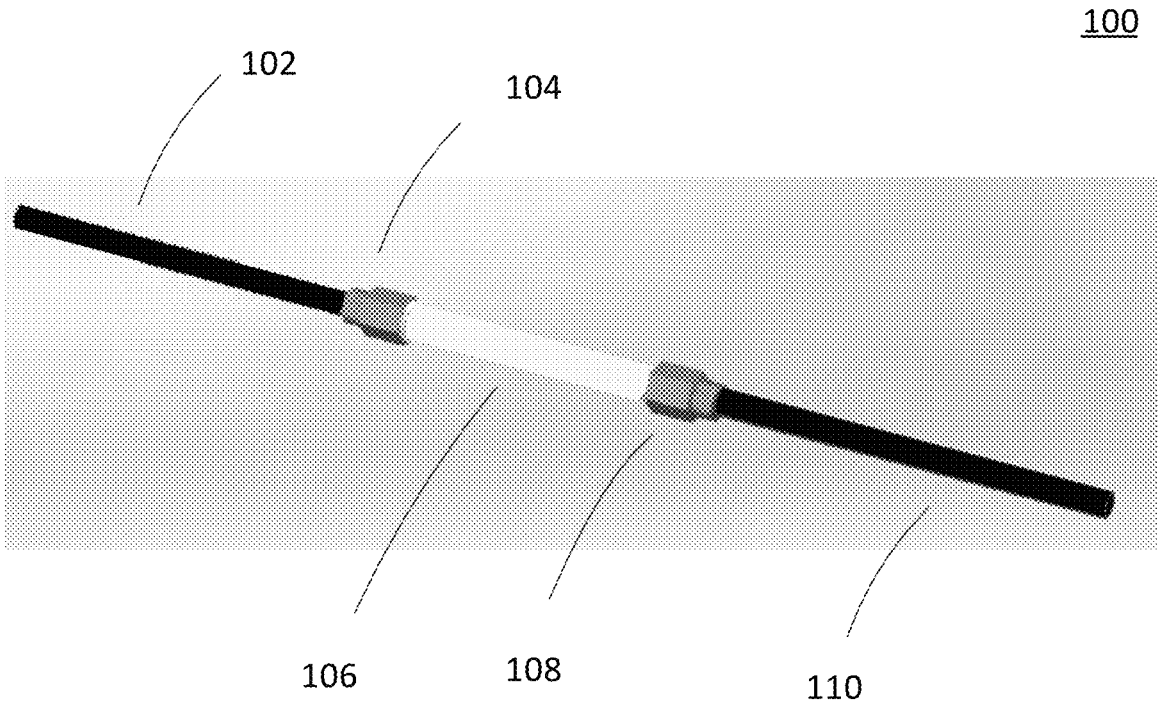
FIG. 1 is an overview of the Non-conductive Break Assembly consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language).

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

HVAC system installations that include metallic lines passing through security partitions or security walls require additional security considerations given the nature of electrically conductive lines to indiscriminately carry electrical impulse. Communications taking place within a secure location that are intended to be limited to the secure location only may be vulnerable to unauthorized perception through analysis of impulses traveling along an electrically conductive line. Consequently, there is a need for a non-conductive refrigerant line break that provides an electrical discontinuity in a metallic refrigerant line.

The present invention allows for a non-conductive break assembly to be installed on a high-pressure refrigerant line that would have developed an induced electrical charge from the refrigerant flowing through the line. In an embodiment, the present invention allows for a non-conductive break assembly to be installed on a high-pressure refrigerant line susceptible to having applied to it an electrical impulse from a power or signal source. In a non-limiting example, a high-pressure refrigerant line carrying R-410a refrigerant would require such a non-conductive break to ensure security against such induced electrical charges or applied electrical impulses. In an embodiment, the present invention could be used for the installation of HVAC units in which metallic high-pressure refrigerant lines would necessarily penetrate a security partition or security wall. By way of non-limiting example, such installation would be used when installing a split-system air conditioning unit inside of a Sensitive Compartmented Information Facility (SCIF). In such example, a conductive line run external to the SCIF would be broken by a non-conductive line prior to or approximately contemporaneously with the conductive line's wall penetration. The non-conductive line would run a distance determined by security considerations to provide sufficient security given the application. The non-conductive line would then be attached to a conductive line within the SCIF.

In an embodiment, the entire non-conductive break assembly is located entirely on the inside cavity created by a wall or partition. In such an embodiment, the entire non-conductive break assembly would benefit from the additional protection from tampering that the wall or partition may provide. In a typical embodiment, an external conductive line penetrates the wall or partition, and then (usually within six inches or some other specified maximum distance) connects to the non-conductive break assembly. Such positioning of the non-conductive break assembly has the advantage of allowing the non-conductive break assembly to remain both fully accessible for inspection and protected from any sort of tampering.

In an embodiment, the present innovation includes a unique feature on the end of the break that increases the bonding surface area for an epoxy sealant inside of the connection. The epoxy sealant provides electrical isolation as it is an electrical insulator. This increased bonding surface area increases the strength of the connection between a conductive portion of the line break and a non-conductive portion of the line break.

In an embodiment, the present invention provides an electrical break in a conductive line (tube) through which utilities are supplied such that the line cannot be used to pass electricity or a signal into or out of a secure space, like a SCIF.

In an embodiment, all conductive and all non-conductive tubes described herein may have one or more exterior surfaces arranged symmetrically around an imaginary axis running the length of each tube. In tube segments bearing male connections, the tube segment surface most distant from the imaginary axis may be threaded. All conductive and all non-conductive tubes described herein may have one or more interior surfaces arranged symmetrically around an imaginary axis running the length of each tube. In tube segments bearing female connections, the tube segment surface nearest the imaginary axis may be threaded to accommodate a corresponding male fitting. In an embodiment, epoxy sealant may be applied to both the threaded portion of each joint connecting a conductive tube to a non-conductive tube and to the extended, non-threaded portion of each joint connecting a conductive tube to a non-conductive tube. In an alternative embodiment, epoxy sealant may be applied to only the extended, non-threaded portion of each joint connecting a conductive tube to a non-conductive tube.

The present invention may be used on high pressure lines including but not limited to those carrying refrigerant, air, or compressed gases. In varying the material carried, it is necessary to match the chemical compatibility of the break materials with the process gas or fluid, and, similarly, process temperature. In an embodiment, the instant break has been tested for compatibility with R410a refrigerant and Polyolester (POE) oil (the oil used in R410a systems). The non-conductive break may also be utilized with pipes carrying air, dry nitrogen, argon, and the refrigerants R134a or the new R32.

In an embodiment, the non-conductive breaks of the instant invention have achieved a minimum burst pressure of 3000 psig, which correlates to working pressure of 600 psig per the United Laboratories' testing criteria of working pressure being ⅕ burst pressure, although this benchmark should in no way be considered limiting. Additional testing of the instant innovation with higher minimum burst pressures above 3000 psig has been performed, but is not yet certified as to the maximum burst pressure achievable. In an embodiment, the non-conductive breaks could be designed to withstand a higher working pressure based upon higher burst pressures yet to be certified.

In an embodiment, the non-conductive break assembly is provided with copper tubes at each end. An installer can terminate to these copper tubes using any manner of standard HVAC copper tube connections (such as, by way of non-limiting example, flare and/or refrigerant press fittings, etc.). To remove the non-conductive break, a worker may disconnect the installer's connection (by way of non-limiting example, a flare) or cut the copper tube that was originally provided with the assembly to readily remove the non-conductive break for upgrade or replacement purposes.

Turning now to FIG. 1, an overview of the Non-conductive Break Assembly consistent with certain embodiments of the present invention is shown. At 100 is a perspective view of the Non-conductive Break Assembly in isolation. The Non-conductive Break Assembly 100 is composed of First Conductive Portion 102, First Fitting Assembly 104, Non-conductive Portion 106, Second Fitting Assembly 108, and Second Conductive Portion 110. In an embodiment, First Conductive Portion 102 runs external to the wall or partition of a secure communications area. In an embodiment, an HVAC system installer would connect a refrigerant source line (not shown) to the First Conductive Portion 102 by way of a standard HVAC copper tube connection. First Conductive Portion 102 is connected to Non-conductive Portion 106 with First Fitting Assembly 104. In an embodiment, this connection is approximately coincident with the outside surface of the wall or partition penetrated. Non-Conductive Portion 106 is connected to Second Conductive Portion 110 with Second Fitting Assembly 108. In an embodiment, Second Fitting Assembly 108 is approximately coincident with the inside surface of the wall or partition penetrated.

Figure 2:
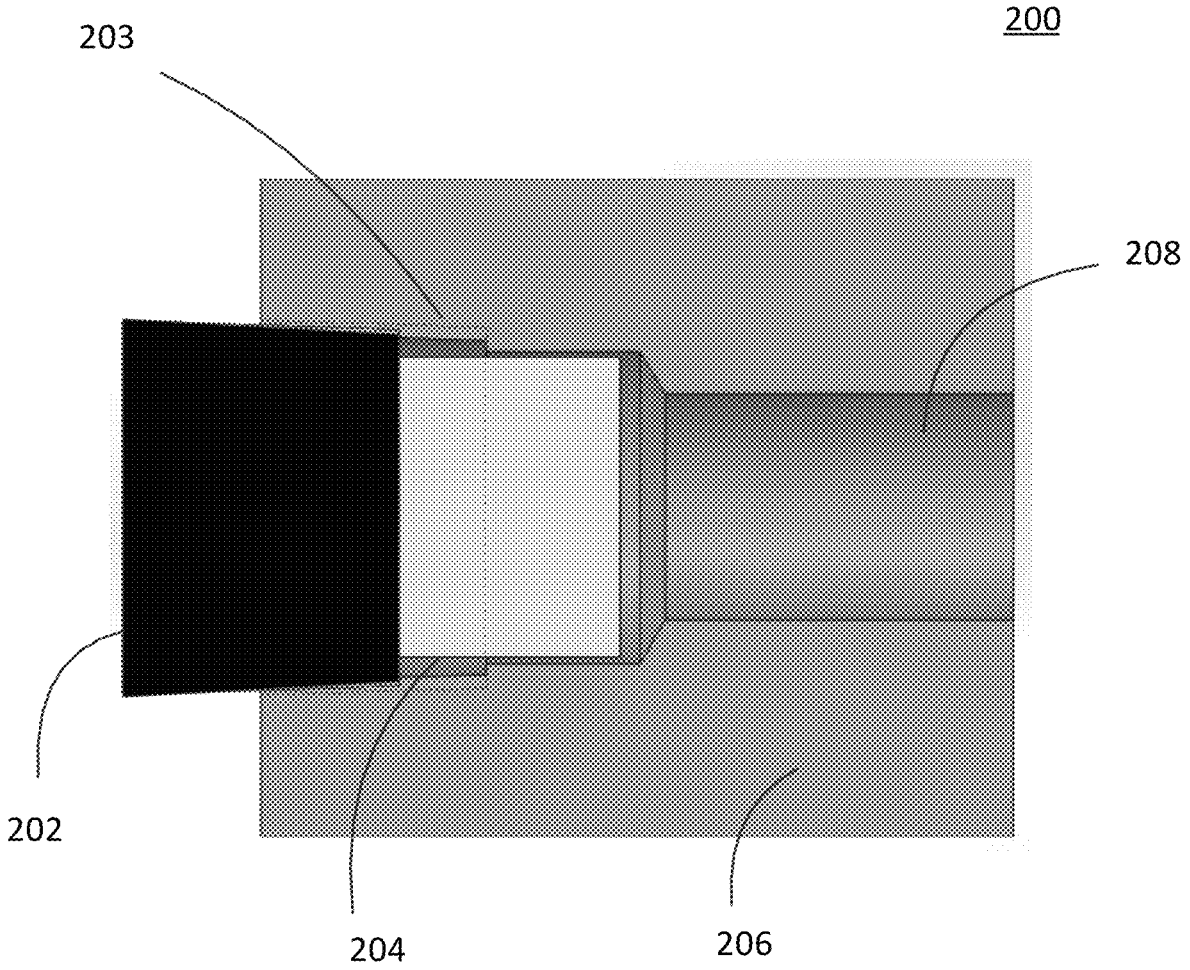
FIG. 2 is a cross-section view of the Second Fitting Assembly consistent with certain embodiments of the present invention.

Turning now to FIG. 2, a cross-section view of the Second Fitting Assembly 200 consistent with certain embodiments of the present invention is shown. Second Fitting Assembly 200 is the point at which fluids flowing through the Non-conductive Break Assembly exit the Non-conductive Portion of the Non-conductive Break Assembly and enter the Second Conductive Portion of the Non-conductive Break Assembly. Non-conductive Portion of the Non-conductive Break Assembly ends in Standardized Male Threaded Portion 202. In an embodiment, Standardized Male Threaded Portion 202 conforms to national pipe thread standards and includes threading on the outside surface and a smooth interior channel. Standardized Male Threaded Portion 202 is directly attached to a Non-threaded Extended Portion 204. In an embodiment, Non-threaded Extended Portion 204 has a smooth exterior and continues the line of the smooth interior channel of Standardized Male Threaded Portion 202. When in an embodiment the Second Fitting Assembly 200 is built, at least a portion of the outside surface of Non-threaded Extended Portion 204 is coated with a chemical bonding agent such as, by way of non-limiting example, an epoxy, capable of chemically bonding the outside surface of Non-threaded Extended Portion 204 to the inside surface of a close-fitting Female Portion 206 of the Second Fitting Assembly 200. In an embodiment the entire outside surface area of Non-threaded Extended Portion 204 may be chemically bonded to the inside surface of close-fitting Female Portion 206, or only a portion of the outside surface area of Non-threaded Extended Portion 204 may be chemically bonded to the inside surface area of close-fitting Female Portion 206.

In an embodiment, at least a portion of the outside surface of Standardized Male Threaded Portion 202 is coated with a chemical bonding agent such as, by way of non-limiting example, an epoxy, capable of chemically bonding the outside surface of Standardized Male Threaded Portion 202 to the inside surface of the threaded close-fitting Female Portion corresponding to Standardized Male Threaded Portion 202. The Threaded Interface between the outside surface of Standardized Male Threaded Portion 202 and the inside surface of the close-fitting Female Portion corresponding to Standardized Male Threaded Portion 202 is represented at 203. The extent of the outside surface area of both male Standardized Male Threaded Portion 202 and Non-threaded Extended Portion 204 available to be bonded and/or actually chemically bonded may vary based upon, at least in part, the intended load pressure. Close-fitting Female Portion 206 leads to Interior Channel 208, which in turn exits from Second Fitting Assembly 200 and into the Second Conductive Portion (not shown). First Fitting Assembly being the point at which fluids flowing through the First Conductive Portion of the Non-conductive Break Assembly enter the Non-conductive Portion of the Non-conductive Break Assembly, the build of the First Fitting Assembly (not shown) is a mirror image of the Second Fitting Assembly 200.

While certain illustrative embodiments have been described, it is evident that many alternatives, modifications, permutations and variations will become apparent to those skilled in the art in light of the foregoing description.

I claim:

1. A device for introducing an electrical break into a conductive line, comprising:

a non-conductive tube terminating in a first and second male fitting where the first male fitting forms a proximal end of said non-conductive tube and the second male fitting forms the distal end of said non-conductive tube;

the first and second male fittings including integral and proximal threaded and non-threaded exterior portions;

the threaded and non-threaded portions of the first and second male fittings having a chemical sealer applied thereto;

the first male fitting being mated with and adhered to a first conductive female fitting; and the second male fitting being mated with and adhered to a second female fitting.

2. The device of claim 1 where a first conductive line portion, a second conductive line portion, and the non-conductive tube when affixed together are designed to carry a high-pressure load.

3. The device of claim 2 where the high-pressure load is equal to or less than 3000 psig.

4. The device of claim 1 where said chemical sealer is an epoxy.

5. The device of claim 1 where the outside surface area of both male Standardized Male Threaded Portion and Non-threaded Extended Portion available to be bonded and/or actually chemically bonded varies based, at least in part, upon the HVAC line load pressure.

6. A device for introducing an electrical break into a conductive line, comprising:

a non-conductive tube joined to a first electrically conductive tube by a fitting at a proximal end and joined to a second electrically conductive tube by a fitting at a distal end;

said fittings each including a male portion and a female portion;

each male portion consisting of a threaded length integrated with a proximal unthreaded length;

each female portion consisting of threaded and unthreaded lengths capable of mating with a corresponding male portion; and at least the threaded and unthreaded length of each male portion being chemically bonded to at least the unthreaded length of its corresponding female portion.

7. The device of claim 6 where the first electrically conductive tube, the second electrically conductive tube, and the non-conductive tube are designed to carry a high-pressure load.

8. The device of claim 7 where the high-pressure load is equal to or less than 3000 psig.

9. The device of claim 6 where said chemical bond is created through the application of an epoxy.

10. The device of claim 6 where the outside surface area of both male Standardized Male Threaded Portion and Non-threaded Extended Portion available to be bonded and/or actually chemically bonded varies based, at least in part, upon the HVAC line load pressure.

* * * * *